US006726309B2

(12) United States Patent
Maki

(10) Patent No.: US 6,726,309 B2
(45) Date of Patent: Apr. 27, 2004

(54) INK JET RECORDING APPARATUS

(75) Inventor: Tadashi Maki, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 41 days.

(21) Appl. No.: 10/180,451

(22) Filed: Jun. 26, 2002

(65) Prior Publication Data

US 2003/0016271 A1 Jan. 23, 2003

(30) Foreign Application Priority Data

Jun. 29, 2001 (JP) ..... 2001-198175

(51) Int. Cl.[7] ..... B41J 2/14; B41J 2/16
(52) U.S. Cl. ..... 347/50
(58) Field of Search ..... 347/50, 20, 1, 347/86, 87, 91, 85, 84, 7, 33, 34, 37, 43, 40

(56) References Cited

U.S. PATENT DOCUMENTS 5,907,343 A 5/1999 Takemura et al.

6,533,393 B1 * 3/2003 Meyer et al. ..... 347/43

* cited by examiner

*Primary Examiner*—Raquel Yvette Gordon
(74) *Attorney, Agent, or Firm*—RatnerPrestia

(57) ABSTRACT

The present invention provides an ink jet recording apparatus in which many components in a carriage-driving system are unitized into a carriage frame. The apparatus comprises a carriage loaded with a recording head for discharging ink from a plurality of nozzles, a carriage-driving device for driving the carriage, a bendable electric wire, and a carriage frame. The electric wire is bent from an apparatus body and mounted to the recording head and passes a printing signal to the recording head. The carriage frame arranges the carriage, the carriage-driving device, the recording head, and the electric wire at predetermined positions to form a unit. The carriage can reciprocate in parallel with the main scan direction along the longitudinal direction of the carriage frame. As a result, the recording head can be easily replaced, and the apparatus can be maintained without complicated work.

18 Claims, 7 Drawing Sheets

INK JET RECORDING APPARATUS

FIELD OF THE INVENTION

The present invention relates to an ink jet recording apparatus for discharging ink from a nozzle and adhering the ink to a recording medium.

BACKGROUND OF THE INVENTION

An ink jet recording apparatus achieves high speed printing of high picture quality at low cost, and is employed as an information recording apparatus for office automation use or personal use. The ink jet recording apparatus is widely used in a copying machine, a facsimile, a printer, or a word processor.

Various technologies have been proposed regarding such an ink jet recording apparatus, and technologies adequate to high-speed recording, high resolution, and full color are now studied earnestly.

The ink jet recording method comprises steps of discharging color material and adhering and fixing the material to a recording medium such as paper. For discharging the color material, a following energy generating means is used; a means using an exothermic resistor such as an electrothermal energy conversion element, a means using a piezoelectric element such as electromechanical energy conversion element, or an electrostatic type means using electric energy.

FIG. 6 is a schematic perspective view of an essential part of one example of typical ink jet recording apparatuses. FIG. 7 is a side sectional view of a recording head and a carriage in the ink jet recording apparatus of FIG. 6.

In FIG. 6 and FIG. 7, carriage 102 loaded with recording head 101 is slidably supported by carriage shaft 103 and guide rail 104, and fixed to belt 108 suspended via belt holder 109 between drive pulley 106 and idler pulley 107 that are mounted to drive motor 105. In this structure, a rotation of drive motor 105 is converted to a reciprocating motion of belt 108, and carriage 102 is slid in the X direction (main scan direction). During the sliding of carriage 102, color material discharged from recording head 101 adheres to recording medium 111 based on a signal sent from electric wire 110.

Conveying roller 112, a plurality of pinch rollers 113, delivering roller 114, and a polarity of spurs 115 move recording medium 111 in the Y direction (sub scan direction) for serial scan, and the ink jet recording is performed.

When the recording head mounted to the carriage becomes clogged to require a replacement of a component in the ink jet recording apparatus discussed above, the disassembling of the apparatus into a plurality of components, the replacement of the component, and subsequent accurate reassembling are required. Thus, much time and much work are disadvantageously required for the replacement.

This problem is solved if the entire ink jet recording apparatus is replaced, but this method is not economical and requires management such as holding or disposing of the removed apparatus.

SUMMARY OF THE INVENTION

The present invention addresses the problem discussed above and aims to provide an ink jet recording apparatus allowing easy replacement of its recording head.

The ink jet recording apparatus of the present invention comprises the following components:

(a) a recording head for discharging ink in different colors from a plurality of nozzles;

(b) an ink tank for supplying the ink to the recording head;

(c) a carriage loaded with the recording head;

(d) a carriage-driving device for driving the carriage;

(e) a bendable electric wire that is bent from an apparatus body and mounted to the recording head, and passes a printing signal to the recording head while changing the bent position in response to the movement of the carriage; and (f) a carriage frame for arranging the carriage, the carriage-driving device, the recording head, and the electric wire at predetermined positions to form a unit.

The carriage can reciprocate in parallel with the main scan direction along the longitudinal direction of the carriage frame. The carriage-driving device comprises a drive pulley, an idler pulley, a drive motor, and a belt. The carriage is fixed to the belt, and the belt is suspended between the drive pulley and the idler pulley and is reciprocated by the drive motor for driving the drive pulley.

Thanks to this structure, the entire carriage frame can be replaced without removing respective components, thereby facilitating the replacement of the recording head.

In the ink jet recording apparatus of the present invention, also, a projection that projects in the forming direction of a nozzle surface for discharging ink of the recording head is formed on the carriage frame. This structure prevents the nozzle surface of a recording head built in newly in the replacing work from contacting with a mounting surface and damaging.

In the ink jet recording apparatus, also, the drive motor and the carriage are disposed on opposite sides of the carriage frame, and a total weight on the carriage side is less than the weight on the drive motor side. In this structure, the carriage frame tilts with the drive motor lying on the lower side, so that the recording head does not contact with the mounting surface. The nozzle surface of the newly built-in recording head in the replacing work can therefore be protected.

A seated height of the carriage is less than the height of the carriage frame in the ink jet recording apparatus, so that the recording head does not contact with the mounting surface and the nozzle surface of the newly built-in recording head in the replacing work can therefore be protected.

A seated height of the electric wire is less than the height of the carriage frame in the ink jet recording apparatus, so that the carriage frame protects the electric wire from an impact to stabilize the electric connection.

A seated height of a feed tube for suppliyng ink to the ink tank is less than the height of the carriage frame in the ink jet recording apparatus, so that the load on a joint between the feed tube and the ink tank is reduced and the ink suppliyng can be stabilized.

The electric wire is coupled to the feed tube for suppliyng ink in the apparatus, so that a head substrate coupling part of the electric wire and an ink tank coupling part of the feed tube do not contact with the mounting surface and therefore the maintenance is facilitated.

A mechanism for applying a tension to the belt is mounted to the carriage frame in the apparatus, so that the replacing work is allowed without removing components.

A position detecting board for detecting positional information of the carriage and a detecting sensor for detecting a position of the carriage are mounted to the carriage frame in the apparatus, so that the replacing work is allowed without removing the position detecting board and the detecting sensor.

An adjusting lever for adjusting a clearance between the recording head and the recording medium is mounted to the carriage frame in the apparatus, so that the replacing work is allowed without removing the adjusting lever.

DETAILED DESCRIPTION OF THE INVENTION

An ink jet recording apparatus of the present invention is described hereinafter in details with reference to the accompanying drawings.

Exemplary Embodiment

Figure 1:
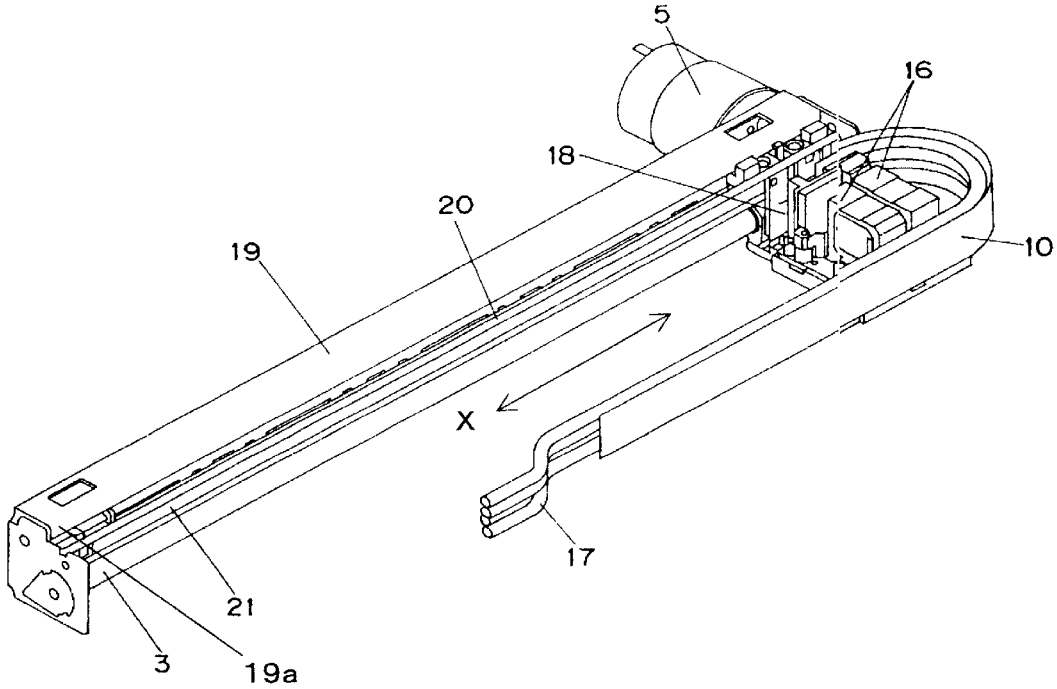
FIG. 1 is a schematic perspective view of a unitized carriage-driving system in an ink jet recording apparatus in accordance with an exemplary embodiment of the present invention.
Figure 2:
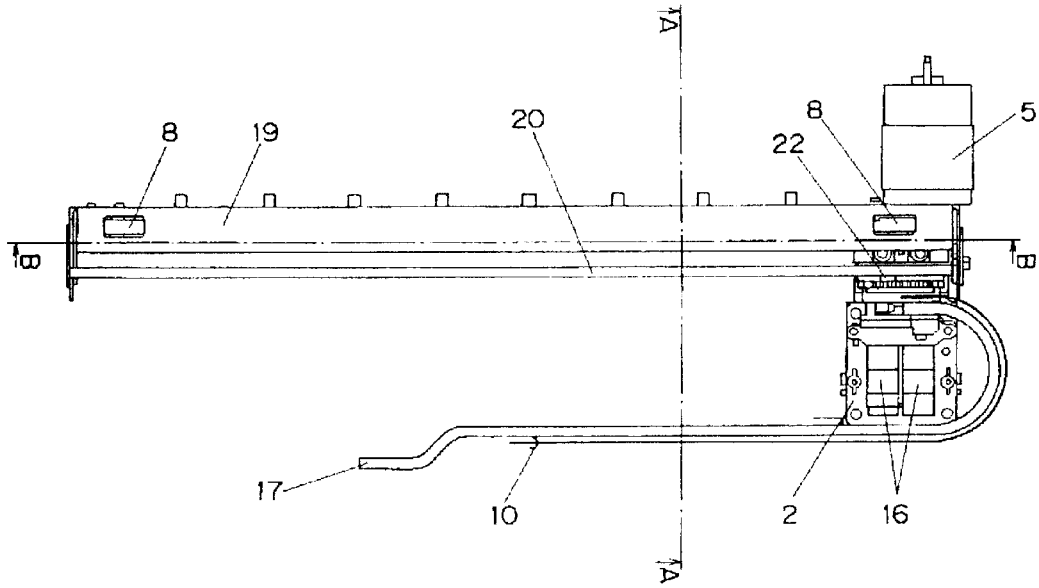
FIG. 2 is a plan view of the unitized carriage-driving system in the ink jet recording apparatus of FIG. 1.
Figure 3:
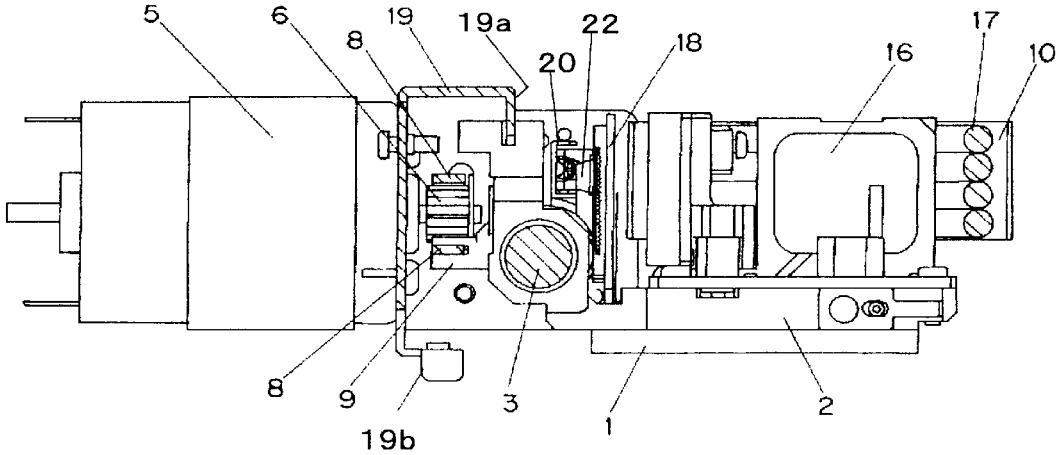
FIG. 3 is a transverse sectional view taken along a line A—A of FIG. 2.
Figure 4:
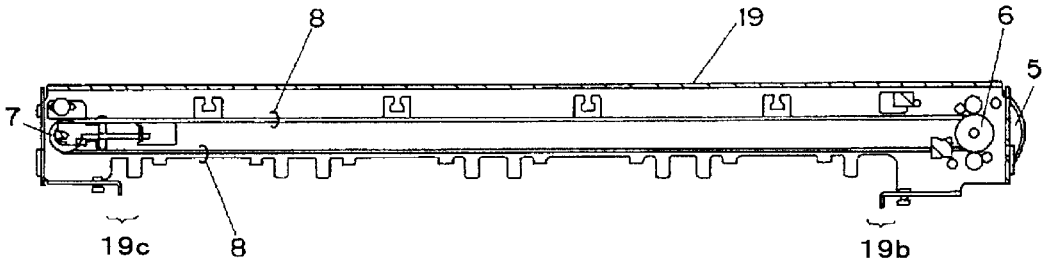
FIG. 4 is a longitudinal sectional view taken along a line B—B of FIG. 2.
Figure 5:
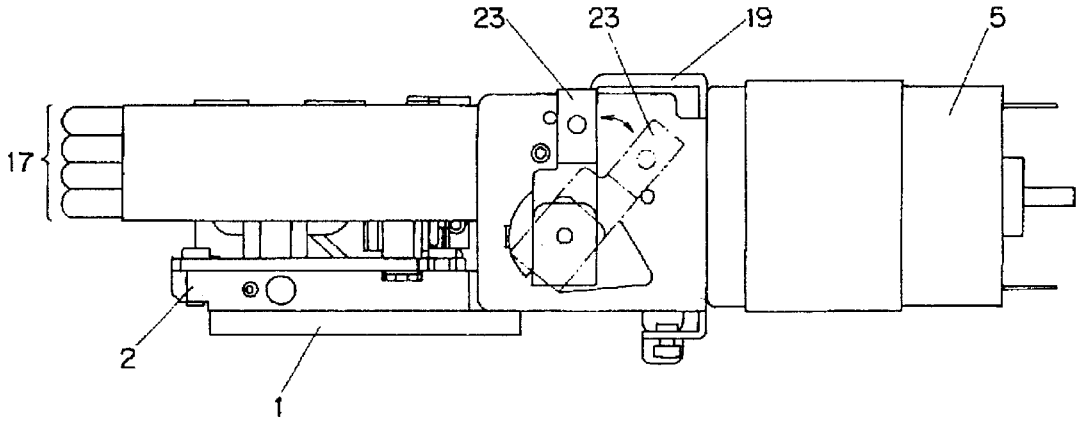
FIG. 5 is a right side view from a drive motor side of the unitized carriage-driving system in the ink jet recording apparatus of FIG. 1.
Figure 6:
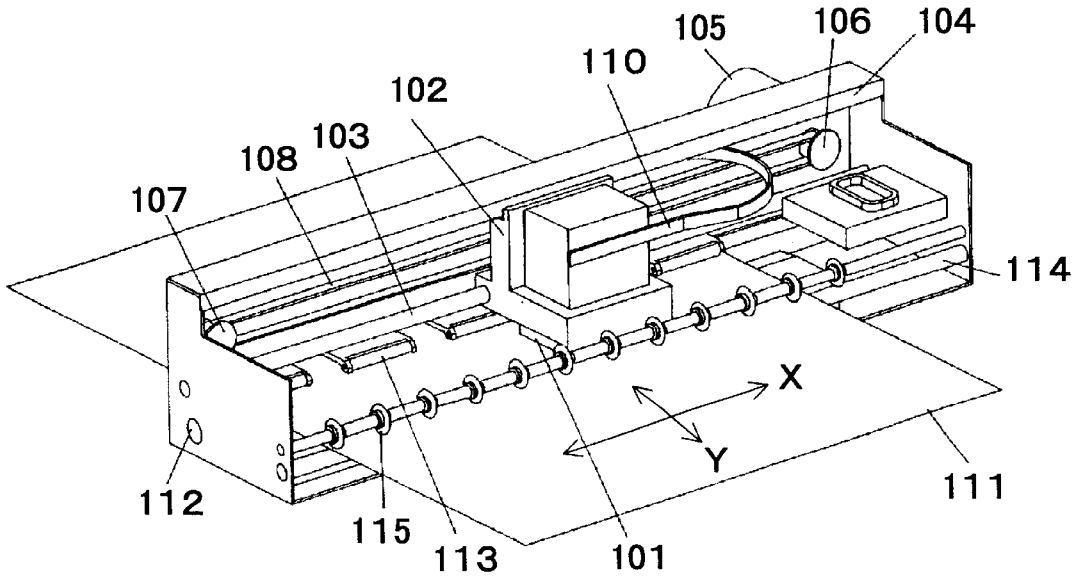
Fig. 6 PRIOR ART
FIG. 6 is a schematic perspective view of a carriage-driving system in a conventional ink jet recording apparatus.
Figure 7:
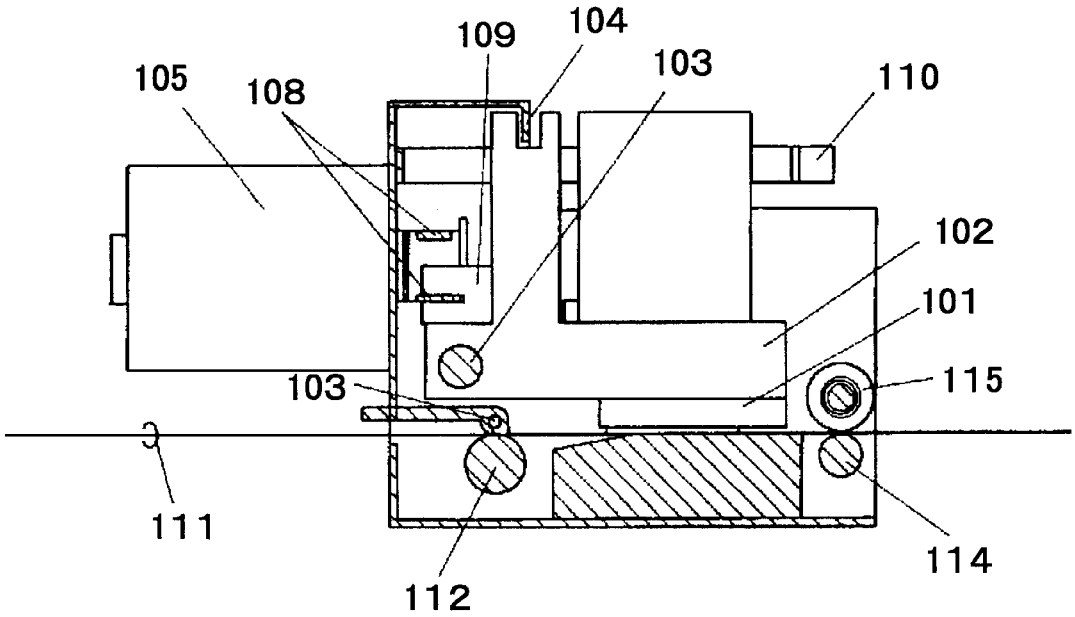
Fig. 7 PRIOR ART
FIG. 7 is a side sectional view of a recording head and a carriage in the ink jet recording apparatus of FIG. 6.

Firstly, a unitized carriage-driving system in the ink jet recording apparatus of the present invention is described with reference to FIG. 1 through FIG. 5. FIG. 1 is a schematic perspective view of the unitized carriage-driving system in the ink jet recording apparatus in accordance with an exemplary embodiment of the present invention. FIG. 2 is a plan view of the unitized carriage-driving system in the ink jet recording apparatus of FIG. 1. FIG. 3 is a transverse sectional view taken along a line A—A of FIG. 2. FIG. 4 is a longitudinal sectional view taken along a line B—B of FIG. 2. FIG. 5 is a right side view from a drive motor side of the unitized carriage-driving system in the ink jet recording apparatus of FIG. 1. The same elements are denoted with the same reference numbers in these drawings, and the same contents are described only once to avoid the duplication.

In FIG. 1 through FIG. 5, the ink jet recording apparatus has recording heads 1 for discharging ink in a plurality of colors. Recording heads 1 comprise a black recording head for discharging black ink, a yellow recording head for discharging yellow ink, a magenta recording head for discharging magenta ink, and a cyan recording head for discharging cyan ink. Each recording head has a plurality of nozzles (not shown) for discharging ink. Ink tanks 16 that reserve the black ink, yellow ink, magenta ink, and cyan ink, respectively, and discharge the inks to respective recording heads 1 are disposed over the recording heads. Recording heads 1 and ink tanks 16 are disposed on carriage 2 in parallel in the moving direction of carriage 2.

Recording heads 1 may be independent, or unitized. The number of colors is four in the present invention; however, the number may be five or six. Here, the black ink, the yellow ink, the magenta ink, and the cyan ink must be employed, so that the number of colors must be four or more. Respective numbers of recording heads 1, ink tanks 16, and feed tubes 17 for suppliyng inks from the outside to ink tanks 16 are increased or decreased depending on the number of colors.

A position corresponding to each nozzle of each recording head 1 has a pressure chamber (not shown) filled with the ink and a piezoelectric actuator (not shown). The piezoelectric actuator has a piezoelectric element and deforms so as to decrease the voltage of the pressure chamber by applying pulsed voltage to the piezoelectric element. The piezoelectric actuator is operated by driving circuit 18 disposed on carriage 2 to discharge the ink downwardly from the pressure chamber to recording paper (not shown) through the nozzle. The piezoelectric element is used as the actuator in the present embodiment; however, a thermal type, an electrostatic type, or the other type of actuator may be used.

Recording heads 1 are fixed to carriage 2. Carriage 2 can move in a main scan direction, namely the X-direction of FIG. 1, while being guided by carriage shaft 3 and carriage frame 19. Carriage 2 is fixed via belt holder 9 to belt 8 suspended between drive pulley 6 and idler pulley 7 that are mounted on the output shaft of drive motor 5, so that carriage 2 can be moved in the main scan direction by belt 8 reciprocated by drive motor 5. Belt holder 9 is fixed to the lower span of belt 8. A DC motor is used as drive motor 5 in consideration of the speeding up and quieting of the operation.

The DC motor is employed as drive motor 5 in the present embodiment; however, the present invention is not limited to the DC motor. Another kind of motor such as a stepping motor may be used.

As shown in FIG. 3, carriage frame 19 has guiding member19*a* at the top position, so that carriage 2 can reciprocate parallel with a main scan direction (X direction). And carriage frame 19 also has projecting parts 19*a*, 19*b* at the bottom position. It will be again described later about projecting parts 19*a*, 19*b*. Carriage 2 is located between top and bottom position of carriage frame 19, and seated height of carriage 2 is set less than a height of carriage frame 19.

A moving distance (an X-directional position of recording head 1) of the carriage is detected by position detecting board 21 and detecting sensor 22. Position detecting board 21 is mounted to position detecting board guide 20 and detects positional information of carriage 2, and detecting sensor 22 is mounted on driving circuit 18 and detects a position of carriage 2. A reflex sensor is used as detecting sensor 22 in the present embodiment; however, instead of the reflex sensor and detecting board, transmission sensor and detecting board may be used to detect a position of carriage 2.

Bendable flat cable 10 is mounted as an electric wire to carriage 2. Flat cable 10 transmits a printing signal, which is used for discharging ink from recording head 1, from a printing signal generating part (not shown) to driving circuit 18. The actuator comprising the piezoelectric element is driven based on the printing signal transmitted through flat cable 10 to discharge the ink from nozzles of recording head 1.

The electric wire is formed of flat cable 10 in the present embodiment; however, the electric wire is not necessarily formed of such a flat cable. One or an assembly of electric wires with a circular radial cross section may be employed, if they are bendable.

The ink jet recording apparatus has adjusting lever 23 for adjusting a clearance between recording head 1 and a recording medium (not shown). The adjustment of the clearance is performed by setting adjusting lever 23 at alternately two different positions, as shown by alternate long and short dash lines in FIG. 5.

In the ink jet recording apparatus of the present embodiment, it is most important that recording head 1, carriage 2, drive motor 5, drive pulley 6, idler pulley 7, belt 8, flat cable 10, ink tank 16, position detecting board 21, and detecting sensor 22 are unitized into carriage frame 19.

When recording head 1 becomes clogged to require the replacement of the head, entire carriage frame 19 is replaced without removing respective components. Thus, the ink jet recording apparatus can be easily maintained without complicated work such as position adjustment of recording head 1.

When projecting parts 19*b*, 19*c* projecting in the forming direction of a nozzle surface for discharging ink of recording head 1 are formed on carriage frame 19, the nozzle surface of recording head 1 built in newly in the replacing work can be prevented from contacting with a mounting surface and damaging.

Next, individual components and their functions are described in more detailed in relation to unitized carriage frame 19 of the ink jet recording apparatus of the present invention. An installing method of drive motor 5 is firstly described. Drive motor 5 and carriage 2 are disposed on the opposite sides of carriage frame 19, and the total weight of the carriage part is less than that of drive motor 5. When unitized carriage frame 19 is mounted in the replacing work or the like, carriage frame 19 tilts with drive motor 5 lying on the lower side. Therefore, recording head 1 does not contact with the mounting surface, and the nozzle surface of newly built-in recording head 1 can be protected.

A seated height of carriage 2 is set less than the height of carriage frame 19, so that recording head 1 does not contact with the mounting surface in the ink jet recording apparatus and the nozzle surface of newly built-in recording head 1 can be protected.

A height (width) of flat cable 10 used as the electric wire is set less than the height of carriage frame 19. Therefore, even when an external impact is applied to carriage frame 19, the electric connection can be stabilized because flat cable 10 is protected from the impact.

A seated height of feed tube 17 for supplying ink to the ink tank is set less than the height of carriage 2 or carriage frame 19. Even when the unitized assembly of carriage frame 19 is handled as one component and mounted on a table or the like, carriage frame 19 mainly supports its own weight. Therefore, a load on the other components (for example, a joint with ink tank 16) is reduced, and the ink supplying can be stabilized.

When flat cable 10 is coupled to feed tube 17, a head substrate coupling part of flat cable 10 and an ink tank coupling part of feed tube 17 do not contact with the mounting surface of the ink jet recording apparatus, and thus the maintenance is facilitated.

Drive motor 5, drive pulley 6, idler pulley 7, and belt 8 that function as a drive transmitting mechanism of carriage 2, and a mechanism for applying a tension to belt 8 are disposed in carriage frame 19. The head replacement required in clogging or the like of the recording head can be easily performed without removing these components.

Position detecting board 21 and detecting sensor 22 that function as a position detecting mechanism of carriage 2 are mounted in carriage frame 19, so that the head replacement required in clogging or the like of recording head 1 can be easily performed without removing these components.

Adjusting lever 23 for varying a distance between recording head 1 mounted to carriage 2 and recording medium 11 is disposed in carriage frame 19, so that the head replacement required in clogging or the like of recording head 1 can be easily performed without removing these components.

In the ink jet recording apparatus of the present invention, as discussed above, many components including the recording head, the carriage, and the drive motor are unitized into the carriage frame. The entire carriage frame can be therefore replaced without removing the components, and the recording head can be easily replaced. Thus, a good ink jet recording apparatus can be provided which can be maintained without complicated work such as the position adjustment of the recording head, and can perform the recording work without applying excessive mechanical load to each precise component or soiling or damaging the component.

What is claimed is:

1. An ink jet recording apparatus comprising:

a recording head for discharging ink;

a carriage for holding said recording head and operable to move in a main scan direction, said carriage having a top, a bottom, and a height;

a carriage-driving device for driving said carriage;

a carriage frame for holding said carriage in a seated position, said carriage frame having a length that is parallel to the main scan direction and being operable to slidably guide the movement of the carriage so that the carriage moves along the length of the carriage frame in the main scan direction, and said carriage frame having a height, wherein the height of said carriage in said seated position is less than the height of said carriage frame.

2. An ink jet recording apparatus according to claim 1, further comprising a carriage-driving device for driving said carriage, wherein said carriage-driving device comprises a drive pulley, an idler pulley, a drive motor, and a belt, said carriage is fixed to the belt, and the belt is suspended between the drive pulley and the idler pulley and is reciprocated by the drive motor for driving the drive pulley.

3. An ink jet recording apparatus according to claim 2, wherein the drive motor and said carriage are disposed on opposite sides of the carriage frame, and a total weight on a carriage side is set less than a weight on a drive motor side.

4. An ink jet recording apparatus according to claim 2, wherein a projection projecting in a forming direction of a nozzle surface for discharging the ink of said recording head is formed on said carriage frame.

5. An ink jet recording apparatus according to claim 2, wherein said carriage frame has a top and a bottom and said carriage is located between the top and the bottom of said carriage frame.

6. An ink jet recording apparatus according claim 2, further comprising a flexible electric wire bent from an apparatus body and mounted to said recording head, said electric wire sending a printing signal to said recording head in response to a movement of said carriage, wherein a seated height of said electric wire is set less than the height of the carriage frame.

7. An ink jet recording apparatus according to claim 2, further comprising an ink tank for supplying the ink to said recording head, wherein a seated height of a feed tube for supplying the ink to said ink tank is set less than a height of one of said carriage and said carriage frame.

8. An ink jet recording apparatus according to claim 2, further comprising a flexible electric wire bent from an apparatus body and mounted to said recording head, said electric wire sending a printing signal to said recording head in response to a movement of said carriage, wherein said electric wire is coupled to a feed tube for supplying the ink.

9. An ink jet recording apparatus according to claim 2, wherein a position detecting board for detecting positional information of said carriage and a detecting sensor for detecting a position of said carriage are mounted to said carriage frame.

10. An ink jet recording apparatus according to claim 2, wherein an adjusting lever for adjusting a clearance between said recording head and a recording medium is mounted to said carriage frame.

11. An ink jet recording apparatus according to claim 1, wherein a projection projecting in a forming direction of a nozzle surface for discharging the ink of said recording head is formed on said carriage frame.

12. An ink jet recording apparatus according to claim 1, wherein said carriage frame has a top and a bottom and said carriage is located between the top and the bottom of said carriage frame.

13. An ink jet recording apparatus according to claim 1, further comprising a flexible electric wire bent from an apparatus body and mounted to said recording head, said electric wire sending a printing signal to said recording head in response to a movement of said carriage, wherein a seated height of said electric wire is set less than the height of the carriage frame.

14. An ink jet recording apparatus according to claim 1, further comprising an ink tank for supplying the ink to said recording head, wherein a seated height of a feed tube for supplying the ink to said ink tank is set less than a height of one of said carriage and said carriage frame.

15. An ink jet recording apparatus according to claim 1, further comprising a flexible electric wire bent from an apparatus body and mounted to said recording head, said electric wire sending a printing signal to said recording head in response to a movement of said carriage, wherein said electric wire is coupled to a feed tube for supplying the ink.

16. An ink jet recording apparatus according to claim 1, wherein a mechanism for applying a tension to the belt is mounted to said carriage frame.

17. An ink jet recording apparatus according to claim 1, wherein a position detecting board for detecting positional information of said carriage and a detecting sensor for detecting a position of said carriage are mounted to said carriage frame.

18. An ink jet recording apparatus according to claim 1, wherein an adjusting lever for adjusting a clearance between said recording head and a recording medium is mounted to said carriage frame.

* * * * *